US009030278B2

(12) United States Patent
Vangala

(10) Patent No.: US 9,030,278 B2
(45) Date of Patent: May 12, 2015

(54) TUNED DIELECTRIC WAVEGUIDE FILTER AND METHOD OF TUNING THE SAME

(75) Inventor: Reddy R. Vangala, Albuquerque, NM (US)

(73) Assignee: CTS Corporation, Elkhart, IN (US)

( * ) Notice: Subject to any disclaimer, the term of this patent is extended or adjusted under 35 U.S.C. 154(b) by 245 days.

(21) Appl. No.: 13/564,822

(22) Filed: Aug. 2, 2012

(65) Prior Publication Data

US 2012/0293283 A1 Nov. 22, 2012

Related U.S. Application Data

(63) Continuation-in-part of application No. 13/103,712, filed on May 9, 2011.

(60) Provisional application No. 61/524,970, filed on Aug. 18, 2011.

(51) Int. Cl.
*H01P 1/20* (2006.01)
*H01P 1/208* (2006.01)
*H01P 7/00* (2006.01)

(52) U.S. Cl.
CPC ..... *H01P 1/2088* (2013.01); *H01P 7/00* (2013.01); *H01P 1/2002* (2013.01)

(58) Field of Classification Search
CPC ..... H01P 1/2002; H01P 3/16; H01P 1/207; H01P 1/208
USPC ..... 333/208, 209, 212
See application file for complete search history.

(56) References Cited

U.S. PATENT DOCUMENTS

| | | | | |
|---|---|---|---|---|
| 4,396,896 | A | | 8/1983 | Williams |
| 4,431,977 | A | | 2/1984 | Sokola et al. |
| 4,609,892 | A | | 9/1986 | Higgins, Jr. |
| 4,692,726 | A | | 9/1987 | Green et al. |
| 4,706,051 | A | * | 11/1987 | Dieleman et al. ..... 333/212 |
| 4,733,208 | A | | 3/1988 | Ishikawa et al. |
| 4,742,562 | A | | 5/1988 | Kommrusch |

(Continued)

FOREIGN PATENT DOCUMENTS

| | | | |
|---|---|---|---|
| CN | 201898182 | U | 7/2011 |
| CN | 102361113 | A | 2/2012 |

(Continued)

OTHER PUBLICATIONS

Paul Wade: "Rectangular Waveguide to Coax Transition Design", QEX, Nov./Dec. 2006, pp. 10-17, published by American Radio Relay League, Newington, Connecticut, U.S.

(Continued)

*Primary Examiner* — Robert Pascal
*Assistant Examiner* — Gerald Stevens
(74) *Attorney, Agent, or Firm* — Daniel J. Deneufbourg

(57) ABSTRACT

A method of tuning the frequency of a waveguide filter including the step of removing dielectric material from one or both of the first and second opposed exterior side surfaces of the waveguide filter to cause a change in the center frequency of the waveguide filter. In one embodiment, dielectric material is removed from one or both of the first and second opposed exterior side surfaces of the waveguide filter in unequal amounts wherein the tuned waveguide filter includes first and second slits defined in the respective first and second opposed exterior side surfaces which extend unequal first and second distances into the body of the waveguide filter.

13 Claims, 2 Drawing Sheets

(56) References Cited

U.S. PATENT DOCUMENTS

| | | | |
|---|---|---|---|
| 4,800,348 | A | 1/1989 | Rosar et al. |
| 4,806,889 | A | 2/1989 | Nakano et al. |
| 4,837,535 | A | 6/1989 | Konishi et al. |
| 4,940,955 | A | 7/1990 | Higgins, Jr. |
| 4,963,844 | A | 10/1990 | Konishi et al. |
| 4,996,506 | A | 2/1991 | Ishikawa et al. |
| 5,004,992 | A | 4/1991 | Grieco et al. |
| 5,023,944 | A | 6/1991 | Bradley |
| 5,130,682 | A | 7/1992 | Agahi-Kesheh |
| 5,208,565 | A | 5/1993 | Sogo et al. |
| 5,243,309 | A | 9/1993 | L'Ecuyer |
| 5,285,570 | A | 2/1994 | Fulinara |
| 5,288,351 | A | 2/1994 | Hoang et al. |
| 5,365,203 | A | 11/1994 | Nakamura et al. |
| 5,382,931 | A | 1/1995 | Piloto et al. |
| 5,416,454 | A | 5/1995 | McVeety |
| 5,525,946 | A | 6/1996 | Tsujiguchi et al. |
| 5,528,204 | A | 6/1996 | Hoang et al. |
| 5,528,207 | A | 6/1996 | Ito |
| 5,537,082 | A | 7/1996 | Tada et al. |
| 5,572,175 | A | 11/1996 | Tada et al. |
| 5,602,518 | A | 2/1997 | Clifford, Jr. et al. |
| 5,719,539 | A | 2/1998 | Ishizaki et al. |
| 5,731,751 | A | 3/1998 | Vangala |
| 5,821,836 | A | 10/1998 | Katehi et al. |
| 5,850,168 | A | 12/1998 | McVeety et al. |
| 5,926,078 | A | 7/1999 | Hino et al. |
| 5,926,079 | A | 7/1999 | Heine et al. |
| 5,929,726 | A | 7/1999 | Ito et al. |
| 5,999,070 | A | 12/1999 | Endo |
| 6,002,306 | A | 12/1999 | Arakawa |
| 6,023,207 | A | 2/2000 | Ito et al. |
| 6,137,383 | A | 10/2000 | De Lillo |
| 6,154,106 | A | 11/2000 | De Lillo |
| 6,160,463 | A | 12/2000 | Arakawa et al. |
| 6,181,225 | B1 | 1/2001 | Bettner |
| 6,255,921 | B1 | 7/2001 | Arakawa et al. |
| 6,281,764 | B1 | 8/2001 | Arakawa et al. |
| 6,329,890 | B1 | 12/2001 | Brooks et al. |
| 6,351,198 | B1 | 2/2002 | Tsukamoto et al. |
| 6,437,655 | B1 | 8/2002 | Andoh et al. |
| 6,504,446 | B1 | 1/2003 | Ishihara et al. |
| 6,535,083 | B1 | 3/2003 | Hageman et al. |
| 6,549,095 | B2 | 4/2003 | Tsukamoto et al. |
| 6,559,740 | B1 | 5/2003 | Schulz et al. |
| 6,568,067 | B2 | 5/2003 | Takeda |
| 6,594,425 | B2 | 7/2003 | Tapalian et al. |
| 6,677,837 | B2 | 1/2004 | Kojima et al. |
| 6,757,963 | B2 | 7/2004 | Meier et al. |
| 6,791,403 | B1 | 9/2004 | Tayrani et al. |
| 6,801,106 | B2 | 10/2004 | Ono et al. |
| 6,834,429 | B2 | 12/2004 | Blair et al. |
| 6,844,861 | B2 | 1/2005 | Peterson |
| 6,888,973 | B2 | 5/2005 | Kolodziejski et al. |
| 6,900,150 | B2 | 5/2005 | Jacquin et al. |
| 6,909,339 | B2 | 6/2005 | Yonekura et al. |
| 6,909,345 | B1 | 6/2005 | Salmela et al. |
| 6,927,653 | B2 | 8/2005 | Uchimura et al. |
| 6,977,560 | B2 | 12/2005 | Itoh et al. |
| 6,977,566 | B2 | 12/2005 | Fukunaga |
| 7,009,470 | B2 | 3/2006 | Yatabe et al. |
| 7,068,127 | B2 | 6/2006 | Wilber et al. |
| 7,132,905 | B2 | 11/2006 | Sano |
| 7,142,074 | B2 | 11/2006 | Kim et al. |
| 7,170,373 | B2 | 1/2007 | Ito et al. |
| 7,271,686 | B2 | 9/2007 | Yoshikawa et al. |
| 7,323,954 | B2 | 1/2008 | Lee et al. |
| 7,449,979 | B2 | 11/2008 | Koh et al. |
| 7,545,235 | B2 | 6/2009 | Mansour et al. |
| 7,659,799 | B2 | 2/2010 | Jun et al. |
| 7,714,680 | B2 | 5/2010 | Vangala et al. |
| 8,008,993 | B2 | 8/2011 | Milson et al. |
| 8,072,294 | B2 | 12/2011 | Tanpo et al. |
| 8,171,617 | B2 | 5/2012 | Vangala |
| 8,284,000 | B2 | 10/2012 | Fukunaga |
| 8,314,667 | B2 | 11/2012 | Uhm et al. |
| 8,823,470 | B2 | 9/2014 | Vangala |
| 2001/0024147 | A1* | 9/2001 | Arakawa et al. ..... 333/135 |
| 2002/0024410 | A1* | 2/2002 | Guglielmi et al. ..... 333/202 |
| 2003/0006865 | A1* | 1/2003 | Kim et al. ..... 333/208 |
| 2004/0000968 | A1 | 1/2004 | White et al. |
| 2004/0056737 | A1 | 3/2004 | Carpintero et al. |
| 2004/0129958 | A1 | 7/2004 | Koh et al. |
| 2004/0257194 | A1 | 12/2004 | Casey et al. |
| 2005/0057402 | A1 | 3/2005 | Ohno et al. |
| 2007/0120628 | A1 | 5/2007 | Jun et al. |
| 2009/0015352 | A1 | 1/2009 | Goebel et al. |
| 2009/0102582 | A1 | 4/2009 | Van Der Heijden et al. |
| 2009/0146761 | A1 | 6/2009 | Nummerdor |
| 2009/0201106 | A1 | 8/2009 | Iio et al. |
| 2009/0231064 | A1 | 9/2009 | Bates et al. |
| 2010/0024973 | A1 | 2/2010 | Vangala |
| 2010/0253450 | A1 | 10/2010 | Kim et al. |
| 2011/0279200 | A1 | 11/2011 | Vangala |
| 2012/0229233 | A1 | 9/2012 | Ito |
| 2012/0286901 | A1 | 11/2012 | Vangala |
| 2013/0214878 | A1 | 8/2013 | Gorisse et al. |

FOREIGN PATENT DOCUMENTS

| | | | |
|---|---|---|---|
| DE | 102008017967 | A1 | 10/2009 |
| EP | 0322993 | A2 | 7/1989 |
| EP | 0322993 | A3 | 4/1990 |
| EP | 0444948 | A2 | 3/1991 |
| EP | 0757401 | A2 | 2/1997 |
| EP | 0859423 | A1 | 8/1998 |
| EP | 1024548 | A1 | 2/2000 |
| EP | 0997964 | A2 | 5/2000 |
| EP | 0997964 | A3 | 9/2001 |
| EP | 1439599 | | 7/2004 |
| FR | 2318512 | A1 | 2/1977 |
| JP | 62038601 | | 2/1987 |
| JP | 2003298313 | | 10/2003 |
| WO | 9509451 | | 4/1995 |
| WO | WO 95/09451 | | 4/1995 |
| WO | WO 00/24080 | | 4/2000 |
| WO | 2005091427 | | 9/2005 |

OTHER PUBLICATIONS

Yoji Isota, Moriyasu Miyazaki, Osami Ishida, Fumio Takeda, Mitsubishi Electric Corporation, "A Grooved Monoblock Comb-Line Filter Suppressing the Third Harmonics", IEEE 1987 MTT-S Digest, pp. 383-386, published by IEEE, New York, New York, U.S.

Ruiz-Cruz J et al.: "Rectangular Waveguide Elliptic Filters with Capacitive and Inductive Irises and Integrated Coaxial Excitation", 2005 IEEE MTT-S International Microwave Symposium, Piscataway, NJ, USA, IEEE, (Jun. 12, 2005) pp. 269-272, XP010844740, DOI: 10.1109.MWSYM.2005.1516577, ISBN: 978-7803-8846-8 p. 269; figures 1,3.

C. Choi, Fig. 2.13, Monolithic Plated Ceramic Waveguide Filters, Mar. 31, 1986, Motorola, Inc., Schaumburg, Illinois, U.S.

Kocbach J. et al: "Design Procedure for Waveguide Filters with Cross-Couplings", 2002 IEEE MTT-S International Microwave Symposium Digest (Cat. No. 02CH37278) IEEE Piscataway, NJ, USA; IEEE MTT-S International Microwave Symposium, IEEE, Jun. 2, 2002, pp. 1449-1452, XP001113877, DOI: 10.1109/WMSYM.2002.1012128 ISBN: 978-0-8703-7239-9 abstract; figure 1.

N. Marcuvitz, Waveguide Handbook, McGraw-Hill Book Co., New York City, Ch. 5, 1951.

Y. Konishi, "Novel dielectric waveguide components—microwave applications of new ceramic materials," Proc. IEEE, vo. 79, pp. 726-740, Jun. 1991.

K. Sano, "Dielectric waveguide filter with low profile and low insertion loss," IEEE Trans. on Microwave Theory & Tech., vol. 47, pp. 2299-2303, Dec. 1999.

K. Sano and T. Yoneyama, "A transition from Microstrip to Dielectric Filled Rectangular Waveguide in Surface Mounting," IEEE MTT-S Int. Microwave Symp. Digest, pp. 813-816, 2002.

(56) References Cited

OTHER PUBLICATIONS

I. Awai, A.C. Kundu, and T. Yamashita, "Equivalent circuit representation and explanation of attenuation poles of a dual-mode dielectric resonator bandpass filter," IEEE Trans. Microwave Theory & Tech., vol. 46, pp. 2159-2163, Dec. 1998.

A.D. Paidus and C. Rossiter, "Cross-coupling in microwave bandpass filters," Microwave Journal, pp. 22-46, Nov. 2004.

Tze-min Shen; Chi-Feng Chen' Huang, Ting-Yi; Wu, Ruey-Beei, "Design of Vertically Stacked Waveguide Filters in LTCC," Microwave Theory and Techniques, IEEE Transactions on, vol. 55, No. 8, pp. 1771,1779, Aug. 2007.

Hung-Yi Chien; Tze-Min Shen; Huang; Ting-Yi; Wei-Hsin Wang; Wu, Ruey-Beei, "Miniaturized Bandpass Filters with Double-Folded Substrate Integrated Resonators in LTCC," Microwave Theory and Techniques, IEEE Transactions on vol. 57, No. 7, pp. 1774, 1782, Jul. 2009.

Bo-Jiun Chen; Tze-Min Shen; Wu, Ruey-Beei, "Dual Band Vertically Stacked Laminated Waveguide Filter Design in LTCC Technology," Microwave Theory and Techniques, IEEE Transactions on, vol. 57, No. 6, pp. 1554, 1562, Jun. 2009.

Wolfram Wersing, Microwave ceramics for resonators and filters, Current Opinion in Solid State and Materials Science, vol. 1, Issue 5, Oct. 1996, pp. 715-731, ISSN 1359-0286.

* cited by examiner 100
101
102
103
104
106
108
110
112
114
116
118
120
122
124
126
128
130
132
134
136
138
140
142
146
148
152
154
156
160
180
$L_u$
$W_u$
$W_{S1}$
$W_{S2}$

TUNED DIELECTRIC WAVEGUIDE FILTER AND METHOD OF TUNING THE SAME

CROSS REFERENCE TO RELATED AND CO-PENDING APPLICATIONS

This application claims the benefit of the filing date and disclosure of U.S. Provisional Patent Application Ser. No. 61/524,970 filed on Aug. 18, 2011, the contents of which are entirely incorporated herein by reference as are all references cited therein.

This application also claims the benefit of the filing date and disclosure of, and is a continuation-in-part application of, U.S. patent application Ser. No. 13/103,712 filed on May 9, 2011, the contents of which are also entirely incorporated herein by reference as are all references cited therein.

FIELD OF THE INVENTION

The invention relates generally to dielectric waveguide filters and, more specifically, to a tuned dielectric waveguide filter and method of tuning a dielectric waveguide filter.

BACKGROUND OF THE INVENTION

This invention is related to a ceramic dielectric waveguide filter of the type in which a plurality of resonators are spaced longitudinally along the length of a monoblock and in which a plurality of slits are spaced longitudinally along the length of the monoblock and define a plurality of bridges of ceramic dielectric material between the plurality of resonators.

Experiments have demonstrated that waveguide filters can be accurately modeled using commercially available 3D electromagnetic simulators.

Experiments have also demonstrated that the frequency response curves of an actual prototype waveguide filter nearly matches the modeled waveguide filter but that the center frequency does not match because the absence of accurate information regarding the relative permittivity of the dielectric material of the waveguide filter makes it very difficult to match the center frequency of the actual part to the center frequency of the modeled waveguide filter.

Fortunately, however, within a batch of prototype waveguide filters, the relative permittivity does not vary significantly so that all of the parts made from the same batch of material can be expected to have nearly identical center frequencies assuming reasonable reproduction of dimensions. Tools used to make these waveguide filters are quite expensive which makes it impractical to adjust the tool to match the material properties.

In the case of combline filters of the type disclosed in U.S. Pat. No. 4,800,348 to Rosar et al., it has been standard practice to adjust the center frequency of the filter by tuning individual resonators of the finished filter. This process is time consuming and labor intensive. In the past, bulk tuning was implemented for certain combline filters that were designed without any thick film conductor pattern. However, the majority of combline filters in use today are manufactured with a conductor top print which prevents successful implementation of bulk tuning.

Unlike combline filters, however, there is no simple way of probing individual resonators in a finished waveguide filter, and thus it is very difficult to adjust the filter center frequency by tuning individual resonators. The present invention is directed to a waveguide filter which has been tuned by adjusting the width of the waveguide filter.

SUMMARY OF THE INVENTION

The present invention is directed generally to a waveguide filter which comprises a monoblock of dielectric material including a plurality of exterior surfaces including first and second opposed and spaced-apart exterior side surfaces, at least a first slit defined in the first exterior side surface and extending a first distance into the monoblock, and at least a second slit defined in the second exterior side surface in a relationship opposed and co-linear with the first slit in the first exterior side surface and extending a second distance into the monoblock different than the first distance that the first slit extends into the monoblock.

In one embodiment, the first distance is greater than the second distance.

In one embodiment, the waveguide filter further comprises opposed first and second end notches defined in the monoblock of dielectric material and first and second through-holes which extend through the monoblock of dielectric material and terminate in the first and second notches respectively.

In one particular embodiment, the present invention is directed to a waveguide filter which comprises a monoblock of dielectric material including a plurality of exterior surfaces including opposed and spaced-apart longitudinal exterior top and bottom surfaces and first and second opposed and spaced-apart longitudinal exterior side surfaces, a first plurality of narrow slits defined and extending along the first longitudinal exterior side surface in a spaced-apart relationship and extending a first distance into the monoblock, and a second plurality of narrow slits defined and extending along the second longitudinal exterior side surface in a spaced-apart relationship and in a relationship generally co-linear and opposed to the first plurality of narrow slits and defining a plurality of bridges of dielectric material therebetween that extend along the longitudinal exterior top and bottom surfaces in a spaced-apart relationship, the second plurality of narrow slits extending a second distance into the monoblock different than the first distance that the first plurality of narrow slits extend into the monoblock.

In one embodiment, the first distance is greater than the second distance.

In one embodiment, the waveguide filter further comprises opposed first and second end notches defined in the monoblock of dielectric material and first and second through-holes which extend through the monoblock of dielectric material and terminate in one of the top and bottom surfaces and the first and second end notches respectively.

The present invention is also directed to a method of tuning the center frequency of a waveguide filter which comprises the steps of providing a waveguide filter comprising a monoblock of dielectric material including a plurality of exterior surfaces including first and second opposed and spaced-apart exterior side surfaces, at least a first slit defined in the first exterior side surface and extending a first distance into the monoblock of dielectric material, and at least a second slit defined in the second exterior side surface and extending a second distance into the monoblock of dielectric material, the waveguide filter having a first center frequency; and removing dielectric material from one or both of the first and second exterior side surfaces in either equal or unequal amounts for tuning the center frequency of the waveguide filter.

In one method, equal amounts of dielectric material are removed from both of the first and second exterior side surfaces of the monoblock of the waveguide filter and the first and second distances which the first and second slits extend into the monoblock of dielectric material are equal.

In one method, unequal amounts of dielectric material are removed from both of the first and second exterior side surfaces of the monoblock of the waveguide filter and the first and second distances which the first and second slits extend into the monoblock of dielectric material are unequal.

In one particular embodiment, the method of tuning the frequency of a waveguide filter comprises the steps of providing a waveguide filter comprising a monoblock of dielectric material including a plurality of exterior surfaces including opposed and spaced-apart exterior top and bottom surfaces and first and second opposed and spaced-apart exterior side surfaces, a plurality of first slits defined and extending along the length of the first exterior side surface in spaced-apart relationship, a plurality of second slits defined and extending along the length of the second exterior side surface in spaced-apart relationship and in a relationship opposed to the plurality of first slits to define a plurality of spaced-apart bridges of dielectric material in the monoblock of dielectric material, first and second notches defined in the monoblock of dielectric material, and first and second through-holes extending through the monoblock of dielectric material and terminating in the first and second end notches respectively; and removing dielectric material from one of both of the first and second exterior side surfaces in either equal or unequal amounts for tuning the frequency of the waveguide filter.

In one method, equal amounts of dielectric material are removed from both of the first and second exterior side surfaces of the monoblock of the waveguide filter and the first and second distances which the first and second slits extend into the monoblock of dielectric material are equal.

In one method, unequal amounts of dielectric material are removed from both of the first and second exterior side surfaces of the monoblock of the waveguide filter and the first and second distances which the first and second slits extend into the monoblock of dielectric material are unequal.

Other advantages and features of the present invention will be more readily apparent from the following detailed description of the preferred embodiment of the invention, the accompanying drawings, and the appended claims.

BRIEF DESCRIPTION OF THE DRAWINGS

These and other features of the invention can best be understood by the following description of the accompanying FIGURES as follows.

DETAILED DESCRIPTION OF THE EMBODIMENT

Figures 1, 2:
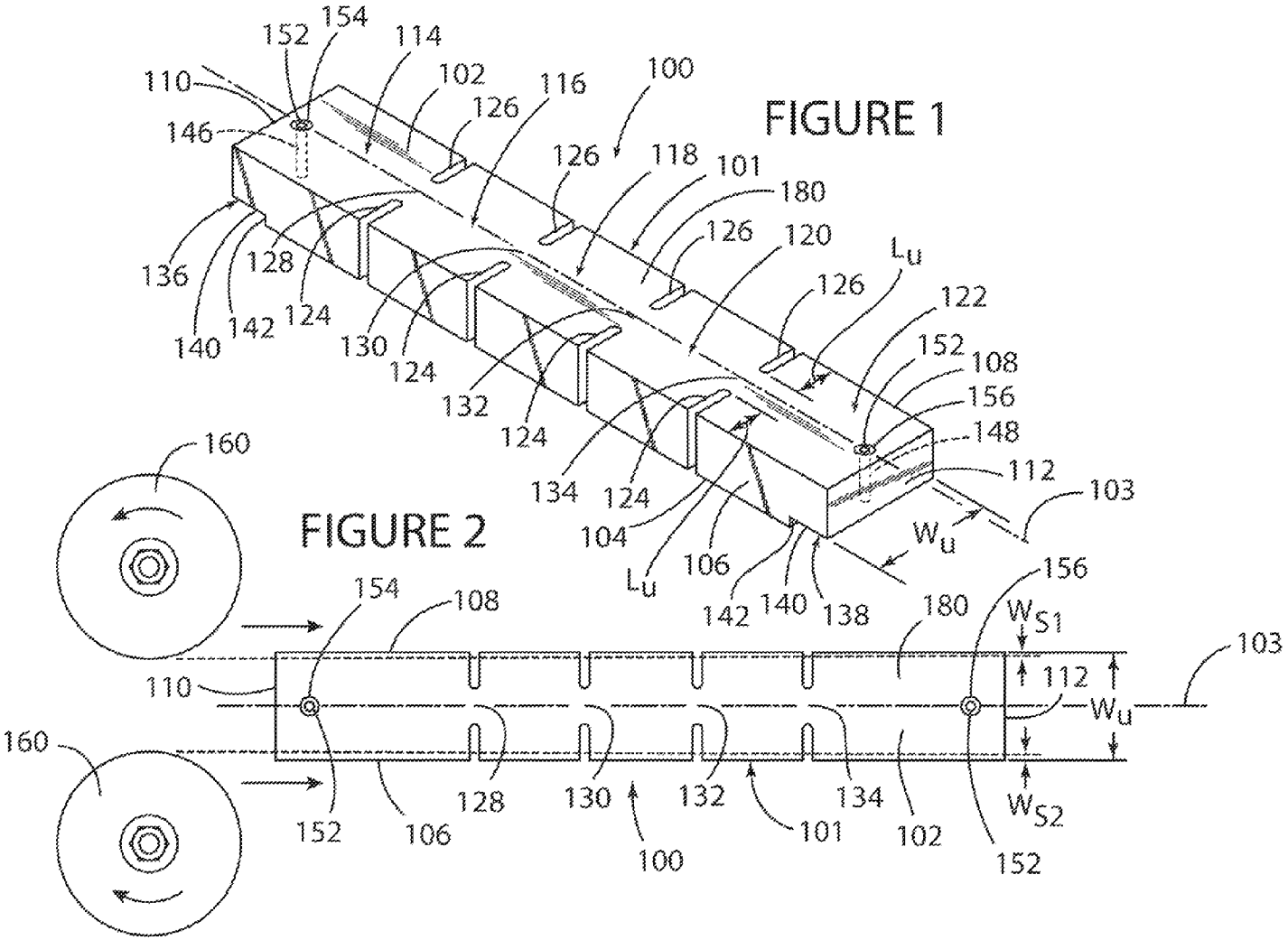
FIG. 1 is an enlarged perspective view of a ceramic dielectric waveguide filter prior to tuning.
FIG. 2 is an enlarged simplified plan view depicting one of the means and method in accordance with the present invention for tuning the ceramic dielectric waveguide filter shown in FIG. 1.

FIG. 1 depicts one embodiment of a ceramic dielectric waveguide filter 100 of the type adapted to be tuned in accordance with the principles of the present invention.

The ceramic dielectric waveguide filter 100 is made from a generally parallelepiped-shaped monoblock 101 comprised of any suitable dielectric material, such as for example ceramic; defines a longitudinal axis 103; and includes a plurality of exterior surfaces including opposed, spaced-apart, parallel, longitudinal and horizontally extending exterior top and bottom surfaces 102 and 104 respectively that extend in the same direction as the longitudinal axis 103; opposed, spaced-apart, parallel, longitudinal and vertically extending exterior side surfaces 106 and 108 that extend in the same direction as, and in a relationship spaced and on opposite sides of, the longitudinal axis 103; and opposed, spaced-apart, parallel, transverse and vertically extending exterior side end surfaces 110 and 112 that extend in a relationship normal to, and intersecting, the longitudinal axis 103.

The monoblock 101 includes a plurality of resonant sections (also referred to as cavities or cells or resonators) 114, 116, 118, 120, and 122 which are comprised of the ceramic dielectric material of the monoblock 101, are spaced longitudinally along the length of the monoblock 101 in an adjacent and side-by-side relationship wherein the longitudinal axis 103 extends through the center of the respective resonators, and are separated from each other by a plurality of spaced-apart vertical narrow slits or slots 124 and 126 which are cut into the surfaces 102, 104, 106, and 108 of the monoblock 101 and are oriented in and extend in a relationship and direction generally perpendicular or normal to the longitudinal axis 103 of the monoblock 101.

The slits or slots 124 are located on a first side of the monoblock 101 and the longitudinal axis 103 thereof and extend along the length of the side surface 106 of the monoblock 101 in a spaced-apart and parallel relationship. Each of the slits 124 cuts through the side surface 106 and the opposed horizontal surfaces 102 and 104 and partially inwardly through the body of the monoblock 101 in the direction of the longitudinal axis 103 of the monoblock 101.

The slits 126 are located on a second opposed side of the monoblock 101 and the longitudinal axis 103 thereof and extend along the length of the opposed side surface 108 of the monoblock 101 in a spaced-apart and parallel relationship and in a relationship opposed, co-planar, and co-linear with the respective slits 124 defined in the side surface 106. Each of the slits 126 cuts through the side surface 108 and the opposed horizontal surfaces 102 and 104 and partially inwardly through the body of the monoblock 101 in the direction of the longitudinal axis 103 of the monoblock 101.

By virtue of their opposed, spaced, co-planar, and co-linear relationship on opposite sides of the monoblock 101 and the longitudinal axis 103 thereof, the slits 124 and 126 together define a plurality of generally centrally located RF signal bridges 128, 130, 132, and 134 in the monoblock 101 which are comprised of the dielectric ceramic material which comprises the monoblock 101 and extend between and interconnect the respective resonators 114, 116, 118, 120, and 122 and allow for passage of the RF signal between the respective resonators. In the embodiment shown, the width of each of the RF signal bridges 128, 130, 132, and 134 is dependent upon the distance between the opposed slits 124 and 126 and, in the embodiment shown, is approximately one-third the width of the monoblock 101.

Moreover, in the embodiment shown, the RF signal bridges 128, 130, 132, and 134 extend along the top and bottom surfaces 102 and 104 of the monoblock 101 in a spaced-apart and generally parallel relationship; the top surface of each of the RF signal bridges 128, 130, 132, and 134 is generally co-planar with the top surface 102 of the monoblock 101; the bottom surface of each of the RF signal bridges 128, 130, 132, and 134 is co-planar with the bottom surface 104 of the monoblock 101; and the RF signal bridges 128, 130, 132, and 134 are oriented and extend in a relationship generally co-linear with the longitudinal axis 103 of the monoblock 101.

Although not shown in any of the FIGURES, it is understood that the thickness or width of each of the slits 124 and 126 and the depth or distance which the slits 124 and 126 extend from the respective one of the side surfaces 106 or 108 into the body of the monoblock 101 may be varied depending upon the particular application to allow the width and the length of each of the RF signal ceramic bridges 128, 130, 132, and 134 to be varied accordingly to allow control of the RF signal passing through the respective bridges, control of the electrical coupling and bandwidth of the waveguide filter 100, and hence control the performance characteristics of the waveguide filter 100.

In the embodiment shown, the waveguide filter 100 and, more specifically the monoblock 101 thereof, additionally comprises and defines respective opposed first and second end steps or notches 136 and 138 that are defined and located adjacent the respective end side surfaces 110 and 112 and extend in a relationship generally normal to and intersecting the longitudinal axis 103, and further that each comprise, in the embodiment shown, a generally L-shaped recessed or grooved or shouldered or notched region or section of the longitudinal surface 104, opposed side surfaces 106 and 108, and opposed side end surfaces 110 and 112 of the monoblock 101 from which dielectric ceramic material has been removed or is absent.

Further, in the embodiment shown, the waveguide filter 100 and, more specifically, the monoblock 101 thereof, additionally comprises first and second electrical RF signal input/output electrodes in the form of respective first and second through-holes 146 and 148 extending through the body of the monoblock 101 and, more specifically, through the respective steps 136 and 138 and, still more specifically, through the body of the respective end resonators 114 and 122 defined in the monoblock 101 between, and in relationship generally normal to, the surface 140 of the respective steps 136 and 138 and the surface 102 of the monoblock 101 and further in a relationship intersecting and co-linear with the longitudinal axis 103 of the monoblock 101.

Still more specifically, each of the generally cylindrically-shaped input/output through-holes 146 and 148 is spaced from and generally parallel to the respective transverse side end surfaces 110 and 112 of the monoblock 101 and defines respective generally circular openings 150 and 152 located and terminating in the step surface 140 and the monoblock surface 102 respectively.

All of the external surfaces 102, 104, 106, 108, 110, and 112 of the monoblock 101 and the internal surfaces of the input/output through-holes 146 and 148 are covered with a suitable conductive material 180, such as for example silver, with the exception of respective uncoated (exposed ceramic) generally circular regions or rings 154 and 156 on the monoblock surface 102 which surround the openings 152 of the respective input/output through-holes 146 and 148.

FIG. 1 depicts the waveguide filter 100 prior to being tuned in accordance with the present invention and is characterized in that the various dimensions and features thereof including, but not limited to, the untuned width ($W_u$) of the waveguide filter 100, have been selected so that the target center frequency thereof is below the final desired center frequency of the tuned waveguide filter 110 depicted in FIG. 3.

According to the invention, the target frequency is selected such that, for the whole range of dielectric constant variations, the pressing tool produces a waveguide filter 100 at or below the final desired center frequency.

One method in accordance with the present invention for tuning the waveguide filter 100 comprises the steps of making a first small group of waveguide filters 100 from a batch of dielectric material and that have been covered with conductive material as described above, making a second larger group of waveguide filters 100 from the same batch of dielectric material as the first small group of waveguide filters 100 but which do not include any conductive material 180 on any of the surfaces thereof, followed by the step of measuring the center frequency of one or more of the waveguide filters 100 in the first small group of waveguide filters 100, followed by the step of reducing the untuned width ($W_u$) of the waveguide filter(s) 100 in the first small group of waveguide filters 100 by grinding, lapping, or otherwise removing both conductive material and then dielectric material, in the respective widths or amounts generally designated $W_{s1}$ and $W_{s2}$ in FIG. 2, from the face of one or both of the longitudinal vertical side surfaces 106 and 108 thereof to cause a corresponding increase in the center frequency of the waveguide filter 100, followed by the step of recovering with conductive material 180 the face of the surfaces 106 and 108 from which conductive material was removed during the grinding, lapping, or removal step, followed by the step of re-measuring the center frequency of the waveguide filter.

FIG. 2 depicts the grinding/lapping/removal of conductive material and corresponding dielectric material from the face of each of the exterior opposed longitudinal and vertically extending side surfaces 106 and 108 of the monoblock 101 of the waveguide filter 100 using a suitable grinding/lapping/removal tool 160. Although the present invention encompasses grinding/lapping/removing both equal/same and unequal/different amounts of conductive material and corresponding dielectric material from the side surfaces 106 and 108, in the embodiment shown, more material has been ground/lapped/removed from the face of the exterior vertical longitudinal side surface 106 than the opposed face of the exterior vertical longitudinal side surface 108 such that the width $W_{s2}$ is greater than the width $W_{s1}$.

Although FIG. 2 depicts the method in which both conductive and dielectric material are removed from the full length of each of the opposed longitudinal and vertically extending side surfaces 106 and 108 of the monoblock 101, it is understood that the method also includes the steps of grinding/lapping/removal of only a portion of the face from only one of the opposed, parallel, exterior vertical longitudinal side surfaces 106 and 108; and/or grinding/lapping/removal of only a portion of the face from both of the opposed, parallel, exterior vertical longitudinal side surfaces 106 and 108 in equal/same or unequal/different amounts.

According to the invention, the grinding/lapping/removal step as described above, the step of recovering or reapplying conductive material 180 to the ground or lapped surface(s) as described above, and the step of measuring the center frequency of the waveguide filter 100 as described above may all be repeated to cause still further increases in the center frequency of the waveguide filter 100 until the waveguide filter 100 exhibits the desired final center frequency.

Once the desired final center frequency has been established and measured on the one or more waveguide filters 100 in the first smaller group of waveguide filters, the respective final widths $W_t$, $W_{s1}$, and $W_{s2}$ are measured and all of the rest of the waveguide filters made with the given batch of dielectric material are ground/lapped to the same tuned final width $W_t$ and thus the same final desired center frequency preferably by reducing the width of all of the rest of the waveguide filters made with the given batch of dielectric material by the same respective final measured widths or amounts $W_{s1}$ and $W_{s2}$ on each side of the waveguide filter 100.

After all of waveguide filters 100 made with the same batch of dielectric material have been so ground/lapped, the exterior surfaces 106 and 108 of the rest of the waveguide filters in the first small group of waveguide filters 100 are re-covered with conductive material 100 and all of the surfaces 102, 104, 106, 108, 110, and 112 and the internal surfaces of the input/output through-holes 146 and 148 in the second larger group of waveguide filters 100 are covered with conductive material 180.

Figure 3:
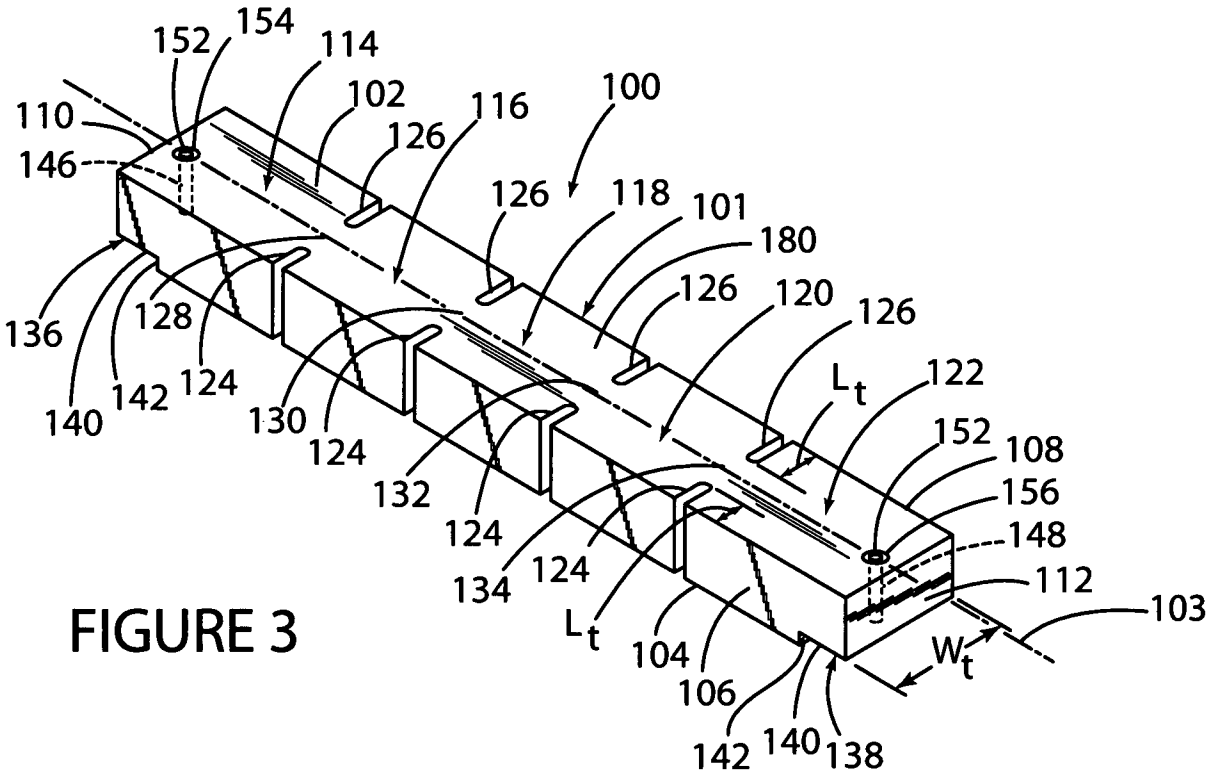
FIG. 3 is an enlarged perspective view of a tuned ceramic dielectric waveguide filter according to the present invention.

Finally, a minor adjustment required to obtain the desired frequency response curve can be accomplished through the removal of conductive material 180 from selected regions of the monoblock 101 of the tuned waveguide filter 100 shown in FIG. 3.

FIG. 3 depicts the waveguide filter 100 of FIG. 1 following the tuning thereof in accordance with the method of the present invention depicted in FIG. 2 and described above in which a greater amount of both conductive material and dielectric material have been ground/lapped/removed from the exterior longitudinal vertical side surface 106 than the opposed, parallel, exterior longitudinal vertical side surface 108.

Thus, FIG. 3 depicts an embodiment of a tuned waveguide filter 100 which is identical in all respects to the waveguide filter 100 shown in FIG. 1, and thus the earlier description of the waveguide filter 100 is incorporated herein by reference, with the exception that the waveguide filter 100 shown in FIG. 3 has a tuned width ($W_t$) which is less than the untuned width ($W_u$) of the waveguide filter 100 shown in FIG. 1 and, more specifically, has a final tuned width ($W_t$) which may be expressed by the formula $W_t=W_u-W_{S1}-W_{s2}$ in which $W_u$ is the untuned width of the original untuned waveguide filter 100 shown in FIG. 1, $W_{S1}$ is the thickness or width of conductive and dielectric material removed from the exterior longitudinal vertical side surface 108 of the monoblock 101 of the waveguide filter 100, and $W_{s2}$ is the thickness or width of conductive material and dielectric material removed for the opposed exterior longitudinal vertical side surface 106 of the monoblock 101 of the waveguide filter 100.

In the embodiment where conductive and dielectric material are ground/lapped/removed from only one of the two opposed, parallel, exterior longitudinal vertical side surfaces 106 and 108, one of the widths $W_{S1}$ and $W_{s2}$ will be zero.

The tuned waveguide filter 100 shown in FIG. 3 also differs in structure from the untuned waveguide filter 100 shown in FIG. 1 in that the waveguide filter 100 shown in FIG. 3, by virtue of the grinding/lapping/removal operation as shown in FIG. 2, includes respective slits 124 and 126 with different respective tuned lengths $L_t$ (FIG. 3), i.e., respective slits 124 and 126 which extend unequal/different distances or lengths $L_t$ into the body of the monoblock 101 which are less than the untuned length $L_u$ (FIG. 2) which the respective slits 124 and 126 extend into the body of the untuned waveguide filter 100 shown in FIG. 1.

In the embodiment of FIG. 3, the tuned length $L_t$ or distance that the slits 126 extend into the body of the monoblock 101 is greater than the tuned length $L_t$ or distance that the slits 124 extend into the body of the monoblock 101 in view that more conductive and dielectric material has been ground/lapped/removed from the face of the exterior longitudinal and vertically extending side surface 106 than has been ground/lapped/removed from the face of the opposed, parallel, exterior longitudinal and vertically extending side surface 108 as shown in FIG. 2.

Stated another way, the tuned waveguide filter 100 shown in FIG. 3 differs in structure from the untuned waveguide filter 100 shown in FIG. 1 in that the tuned waveguide filter 100 shown in FIG. 3, by virtue of the grinding/lapping/removal operation as shown in FIG. 2 and described above, includes respective opposed exterior side surfaces 106 and 108 which are spaced and extend unequal/different distances away from the longitudinal axis 103 of the monoblock 101.

While the invention has been taught with specific reference to the embodiment shown, it is understood that a person of ordinary skill in the art will recognize that changes can be made in form and detail without departing from the spirit and the scope of the invention. The described embodiment is to be considered in all respects only as illustrative and not restrictive.

I claim:

1. A waveguide filter comprising:

a monoblock of dielectric material defining a longitudinal axis and including a plurality of exterior surfaces including first and second opposed and spaced-apart exterior top and bottom surfaces extending in the same direction as the longitudinal axis, first and second opposed and spaced-apart exterior side surfaces extending in the same direction and on opposite sides of the longitudinal axis, first and second opposed and spaced-apart exterior end surfaces extending in a relationship normal to the longitudinal axis, and at least a first through-hole;

at least a first slit defined in the first exterior side surface and extending a first distance into the monoblock;

at least a second slit defined in the second exterior side surface in a relationship opposed and co-linear with the first slit in the first exterior side surface and extending a second distance into the monoblock different than the first distance that the first slit extends into the monoblock; and a step defined in a corner of at least one of the first and second exterior end surfaces of the monoblock of dielectric material, the first through-hole terminating in a first opening in one of the exterior top and bottom surfaces and a second opening in the step.

2. The waveguide filter of claim 1, wherein the first distance is greater than the second distance.

3. The waveguide filter of claim 1 further comprising said at least a first through-hole including the first through-hole and a second through-hole; said step including opposed first and second steps; the opposed first and second steps defined in said corner in each of the first and second exterior end surfaces respectively of the monoblock of dielectric material and said first and second through-holes extending through the monoblock of dielectric material, each of the first and second through-holes terminating in the first opening in one of the first and second exterior top and bottom surfaces and the second opening in the first and second steps respectively.

4. A waveguide filter comprising:

a monoblock of dielectric material defining a longitudinal axis and including a plurality of exterior surfaces including opposed and spaced-apart longitudinal top and bottom exterior surfaces extending in the same direction as the longitudinal axis, first and second opposed and spaced-apart longitudinal exterior side surfaces extending in said same direction and on opposite sides of the longitudinal axis, opposed and spaced-apart exterior end surfaces extending in a direction normal to the longitudinal axis, and at least a first through-hole;

a first plurality of narrow slits defined and extending along the first longitudinal exterior side surface in a spaced-apart relationship and extending a first distance into the monoblock;

a second plurality of narrow slits defined and extending along the second longitudinal exterior side surface in a spaced-apart relationship and in a relationship generally co-linear and opposed to the first plurality of narrow slits and defining a plurality of bridges of dielectric material therebetween and extending along the longitudinal top and bottom surfaces in a spaced-apart relationship, the second plurality of narrow slits extending a second distance into the monoblock different than the first distance that the first plurality of narrow slits extend into the monoblock; and a step defined in a corner of at least one of the exterior end surfaces of the monoblock of dielectric material, the first through-hole terminating in a first opening in one of the exterior top and bottom surfaces and a second opening in the step.

5. The waveguide filter of claim 4, wherein the first distance is greater than the second distance.

6. The waveguide filter of claim 4 further comprising said at least a first through-hole including the first through-hole and a second through-hole; said step including opposed first and second steps; the opposed first and second steps defined in said corner in each of the exterior end surfaces respectively of the monoblock of dielectric material and said first and second through-holes extending through the monoblock of dielectric material, each of the first and second through-holes terminating in the first opening in one of the exterior top and bottom surfaces and the second opening in the first and second steps respectively.

7. A method of tuning the center frequency of a waveguide filter comprising the steps of:

providing an untuned waveguide filter comprising a monoblock of dielectric material having a width and including a plurality of exterior surfaces including first and second opposed and spaced-apart exterior to and bottom surfaces and first and second opposed and spaced-apart exterior side surfaces, at least a first slit defined in the first exterior side surface and extending a first distance into the monoblock of dielectric material, and at least a second slit defined in the second exterior side surface and extending a second distance into the monoblock of dielectric material, the untuned waveguide filter having a center frequency that is below a desired center frequency; and removing dielectric material from the entirety one or both of the first and second exterior side surfaces of the untuned wavequide filter in either equal or unequal amounts to reduce the width of the untuned wavequide filter and tune the center frequency of the untuned waveguide filter to the desired center frequency.

8. The method of claim 7, wherein said equal amounts of the dielectric material are removed from both of the first and second exterior side surfaces of the monoblock of the waveguide filter and the first and second distances which the first and second slits extend into the monoblock of dielectric material are equal.

9. The method of claim 7, wherein said unequal amounts of the dielectric material are removed from both of the first and second exterior side surfaces of the monoblock of the waveguide filter and the first and second distances which the first and second slits extend into the monoblock of dielectric material are unequal.

10. A method of tuning the frequency of a waveguide filter comprising the steps of:

providing an untuned waveguide filter comprising a monoblock of dielectric material having a width and including a plurality of exterior surfaces including opposed and spaced-apart exterior top and bottom surfaces and first and second opposed and spaced-apart exterior side surfaces and opposed and spaced-apart exterior end surfaces, the untuned wavequide filter having a center frequency that is below a desired center frequency;

a plurality of first slits defined and extending along the length of the first exterior side surface in spaced-apart relationship;

a plurality of second slits defined and extending along the length of the second exterior side surface in spaced-apart relationship and in a relationship opposed to the plurality of first slits to define a plurality of spaced-apart bridges of dielectric material in the monoblock of dielectric material, first and second notches defined in the monoblock of dielectric material and extending into the opposed and spaced-apart exterior end surfaces respectively, and first and second through-holes extending through the monoblock of dielectric material and terminating in a surface of the first and second end notches respectively; and removing dielectric material from one or both of the first and second exterior side surfaces of the untuned wavequide filter in either equal or unequal amounts to reduce the width of the untuned wavequide filer and tune the center frequency of the untuned waveguide filter to the desired center frequency.

11. The method of claim 10, wherein said equal amounts of the dielectric material are removed from both of the first and second exterior side surfaces of the monoblock of the waveguide filter and the first and second distances which the first and second slits extend into the monoblock of dielectric material are equal.

12. The method of claim 10, wherein said unequal amounts of the dielectric material are removed from both of the first and second exterior side surfaces of the monoblock of the waveguide filter and the first and second distances which the first and second slits extend into the monoblock of dielectric material are unequal.

13. A method of tuning the center frequency of a wavequide filter to a desired center frequency comprising the steps of:

providing an untuned wavequide filter comprising a monoblock of dielectric material defining a longitudinal axis and having a length, a width, and a height and including a plurality of exterior surfaces including first and second opposed and spaced-apart longitudinally extending exterior top and bottom surfaces, first and second opposed and spaced-apart longitudinally extending exterior side surfaces located on opposite sides of and spaced from the longitudinal axis, first and second opposed and spaced-apart exterior end surfaces extending in a relationship transverse to the longitudinal axis, a step defined in a corner of at least one of the first and second exterior end surfaces, and a through-hole defining a first opening in one of the first and second exterior top and bottom surfaces and a second opening in the step; and removing dielectric material from one or both of the first and second exterior side surfaces of the untuned waveguide filter in either equal or unequal amounts to reduce the width of the untuned wavequide filter and tune the center frequency of the untuned waveguide filter to the desired center frequency.

* * * * *